United States Patent [19]

Nakamura et al.

[11] 4,240,262

[45] Dec. 23, 1980

[54] CRYOPUMP DEVICE

[75] Inventors: Kazuaki Nakamura, Kariya; Yutaka Momose, Toyota, both of Japan

[73] Assignee: Aisin Seiki Kabushiki Kaisha, Kariya, Japan

[21] Appl. No.: 41,422

[22] Filed: May 22, 1979

[30] Foreign Application Priority Data

May 24, 1978 [JP] Japan ..... 53-61899

[51] Int. Cl.[3] ..... B01D 8/00

[52] U.S. Cl. ..... 62/55.5; 62/268; 55/269; 417/901

[58] Field of Search ..... 62/55.5, 100, 268; 55/269; 417/901

[56] References Cited

U.S. PATENT DOCUMENTS

| | | | |
|---|---|---|---|
| 3,282,058 | 11/1966 | Venema et al. | 62/6 |
| 3,338,063 | 8/1967 | Hogan et al. | 62/55.5 |
| 3,423,947 | 1/1969 | Moriya | 62/55.5 |
| 3,485,054 | 12/1969 | Hogan | 62/55.5 |
| 3,721,101 | 3/1973 | Sheppard | 62/55.5 |
| 4,121,430 | 10/1978 | Bächler et al. | 62/268 |

*Primary Examiner*—Ronald C. Capossela

*Attorney, Agent, or Firm*—Finnegan, Henderson, Farabow, Garrett & Dunner

[57] ABSTRACT

A cryopump device comprising a refrigerator section which has at least two expansion chamber cooling elements disposed in a space to be evacuated, a shielding wall disposed in the space encircling both expansion chamber cooling elements and formed by a thermally conductive material, the shielding wall being in heat transfer contact with one of the expansion chamber cooling elements, a condensation panel disposed inside the shielding wall and being in heat transfer contact with the other of the expansion chamber cooling elements, the shielding wall having an opening proximate the condensation panel so that the space is cooled by the other expansion chamber cooling element through the condensation panel.

6 Claims, 3 Drawing Figures

CRYOPUMP DEVICE

The present invention relates to cryopump devices which are utilized as cryocondensation pumps or cryosorption pumps.

Such cryopump devices are used for assisting evacuation of a chamber. In general a gas medium refrigerator can produce a cryogenic temperature of up to 80° K. However, various types of gases such as nitrogen, carbon monoxide and methane which may exist in the chamber to be evacuated have relatively high saturation vapor pressure at the temperature of approximately 80° K. so that it is generally impossible to produce an extremely strong vacuum in the chamber.

In order to solve the problem, it has been proposed to provide means for having condensed the gases in the chamber to be evacuated by applying a cryogenic temperature to the chamber. For example, U.S. Pat. No. 3,282,058 corresponding to Japanese patent publication No. sho 45-26553 published on Sept. 1, 1970 discloses a cryopump device for applying an extremely low temperature to a chamber to be evacuated. The device includes a two stage refrigerator section having first and second stage expansion chambers, the casing for the first stage expansion chamber being in heat transfer contact with a shielding wall which encircles a space to be evacuated and the casing for the second expansion chamber being located in the space and in heat transfer contact with a condensation panel disposed in the space. In this arrangement, the shielding wall is maintained at a low temperature as produced by the first stage expansion chamber and a lower temperature is applied to the space from the second stage expansion chamber through the condensation panel.

It has been found that, in this type of arrangement, a desired low temperature cannot be established since the temperature of the first stage expansion chamber is unavoidably increased. A further disadvantage of this arrangement is caused by the structure of the condensation panel. Usually, the condensation panel has a layer of zeolite, active carbon or molecular sieve adhesively attached to the base plate. However, due to the insufficiency of the thermal shield at the shielding wall, such layer can be formed only at one side of the condensation panel so that the whole surface of the condensation panel cannot be utilized in an effective manner.

It is therefore an object of the present invention to provide a cryopump device which can produce a strong vacuum.

Another object of the present invention is to provide a cryopump device which can apply an extremely low temperature to the space to be evacuated.

According to the present invention, the above and other objects can be accomplished by a cryopump device comprising a refrigerator section which has at least two expansion chamber means disposed in a space to be evacuated, shielding wall means disposed in said space encircling said at least two expansion chamber means and formed by a thermally conductive material, said shielding wall means being in heat transfer contact with one of the expansion chamber means, condensation panel means disposed inside the shielding wall means and being in heat transfer contact with the other of the expansion chamber means, said shielding wall means having opening means proximate the condensation panel means so that said space is cooled by the other expansion chamber means through said condensation panel means. In order to protect the condensation panel means, said shielding wall means may be provided at the opening means with lower means or the like. Said one or the other or both of the expansion chamber means may be such type having two or more expansion stages.

The above and other objects and features of the the present invention will become apparent from the following descriptions of preferred embodiments taking reference to the accompanying drawings, in which.

Figure 1:
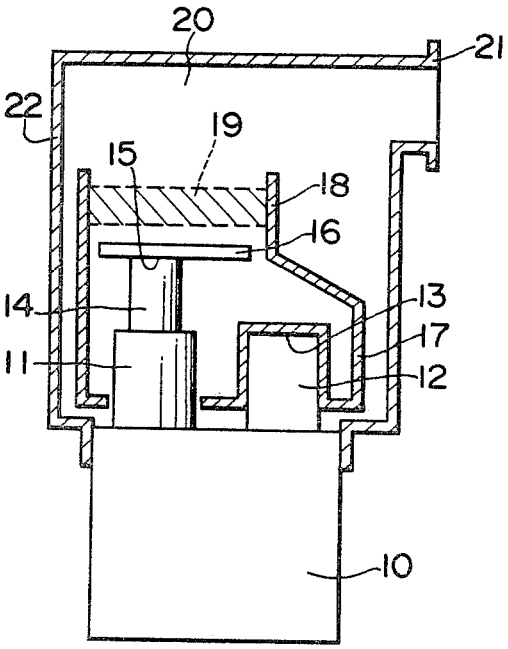
FIG. 1 is a sectional view of a cryopump device in accordance with one embodiment of the present invention.

Referring now to the drawings, particularly to FIG. 1, there is shown a cryocondensation pump device which comprises a gas coolant type refrigerator 10 using helium gas as the coolant or cooling medium.

The refrigerator 10 has expansion chambers 11 and 12 which are intended to produce a relatively high average temperature, for example, 80° K. One of the expansion chambers 11 is further provided with a second stage expansion chamber 14 having an end wall 15. The expansion chamber 14 is designed for producing a lower average temperature, for example, 20° K. A condensation panel 16 is disposed in heat transfer contact with the end wall 15 of the second stage expansion chamber 14.

A thermally shielding wall 17 made of a thermally conductive material is provided in heat transfer contact with the casing wall 13 of the expansion chamber 12 and encircles the expansion chambers 11 and 14 and the condensation panel 16. The shielding wall 17 is out of contact with or thermally insulated from the expansion chambers 11 and 14. The shielding wall 17 has an open end 18 to expose the condensation panel 16 and a louver 19 or the like may be provided in the open end 18 in order to protect the panel 16 from oil or vapor of water. A housing 22 is provided to define a space 20 and encircle the expansion chambers 11, 12 and 14 and the shielding wall 17. The housing 22 has an opening 21 which is adapted to be connected with a part where the low temperature is applied.

Figure 2:
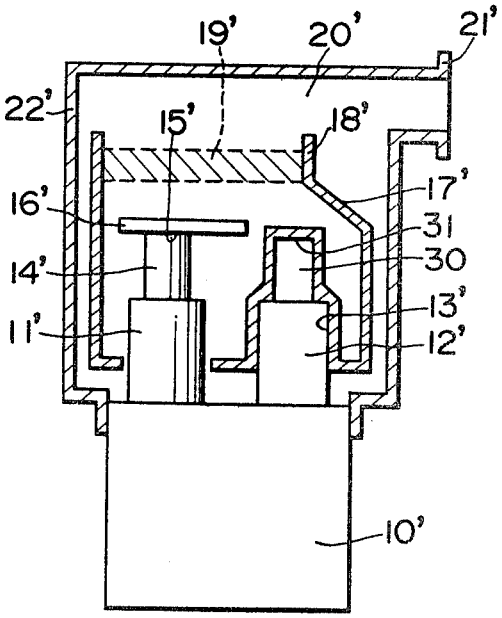
FIG. 2 is a sectional view similar to FIG. 1 but showing another embodiment of the present invention; and, FIG. 3 is a sectional view showing a further embodiment of the present invention.

Referring now to FIG. 2, the cryocondensation shown therein is similar in construction to that shown in FIG. 1 so that corresponding parts are designated by the same reference numerals with the addition of single prime (′). The device shown therein is different from the device shown in FIG. 1 in that the expansion chamber 12′ is provided with a second stage expansion chamber 30 to produce a temperature which is lower than that produced at the expansion chamber 12′. The shielding wall 17′ is in heat transfer contact with both the expansion chambers 12′ and 30 at their walls 13′ and 31.

Figure 3:
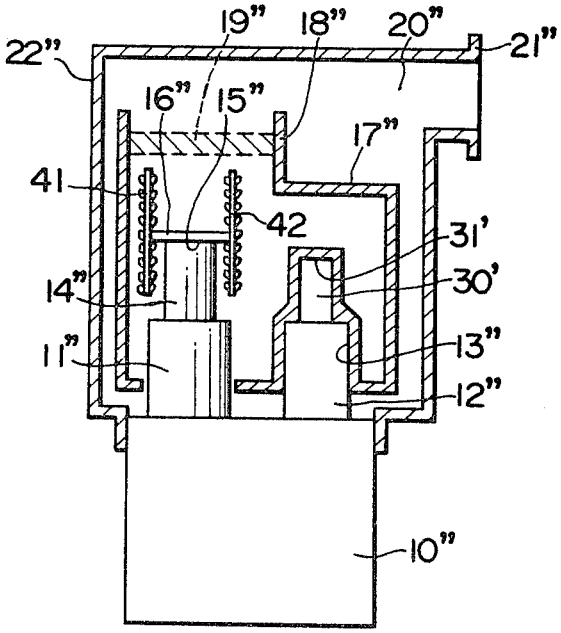

Referring to FIG. 3, there is shown a cryosorption pump which is similar in construction to the pump shown in FIG. 2 so that corresponding parts are designated by the same reference numerals as in FIG. 2 with addition of double prime (″). In this device, a condensation panel 16″ is provided in heat transfer contact with the wall 15″ of the second stage expansion chamber 14″ and carries a pair of vertical plates 41 and 42 secured thereto. The plates 41 and 42 are attached with absorptive material such as zeolite.

According to the above described arrangements of the present invention, the shielding wall encircles the primary and secondary expansion chambers to provided a thermally shielded space so that it is possible to establish an extremely low temperature, for example, 20° K., Therefore, gases having relatively low dew points such as hydrogen, nitrogen, oxygen or the like can even be condensed on the condensation panel. Gases having relatively high dew points such as water, carbon dioxide, or acetylene may be condensed on the shielding wall. In the cryosorption pump as shown in FIG. 3, gases in the space are partially absorbed by the absorptive material on the vertical plates and partially condensed on the condensation panel. Thus, it is possible to establish an extremely strong vacuum in the space.

From the above descriptions, it will be noted that the present invention provides a cryopump device which is simple in construction but has a substantially improved performance by utilizing a refrigerating unit having at least two expansion chambers, one chamber being utilized to cool the shielding wall which encircles the other chamber. Since the other expansion chamber is out of contact with or thermally insulated from the shielding wall, it is possible to establish a substantially perfect thermal shielding. Therefore, the condensation panel may be provided with an absorptive plate as shown in FIG. 3.

The invention has thus been shown and described with reference to specific embodiments which are believed as being preferable in embodying the concepts of the present invention; however, it should be noted that the invention is in no way limited to the details of the illustrated structures but changes and modifications may be made without departing from the scope of the appended claims.

We claim:

1. A cryopump device comprising a refrigerator section which has at least two expansion chamber means disposed in a space to be evacuated, shielding wall means disposed in said space and encircling said at least two expansion chamber means, said shielding wall means being formed of a thermally conductive material, said shielding wall means being in heat transfer contact with one of said at least two expansion chamber means, condensation panel means disposed inside the shielding wall means and being in heat transfer contact with the other of said at least two expansion chamber means, said shielding wall means having opening means proximate said condensation panel means for providing cooling of said space by the other expansion chamber means through said condensation panel means.

2. The cryopump device in accordance with claim 1 in which louver means for protecting the condensation panel means is provided in said shielding wall means at said opening means.

3. The cryopump device in accordance with claim 1 in which said other expansion chamber means is of the two stage type having primary and secondary expansion chambers, and the condensation panel means is in heat transfer contact with the secondary expansion chamber.

4. The cryopump device in accordance with claim 3 in which said one expansion chamber means is of the two stage type having primary and secondary expansion chambers which are both in heat transfer contact with the shielding wall means.

5. The cryopump device in accordance with claim 4 further including absorptive plate means having absorptive material applied thereto said absorptive plate means being attached to said condensation plate means and being positioned within said shielding wall means.

6. The cryopump device in accordance with claim 1 wherein said at least two expansion chamber means are supplied from a common gas-coolant type refrigerator.

* * * * *